United States Patent [19]

Negaty-Hindi et al.

[11] 4,406,115

[45] Sep. 27, 1983

[54] METHOD OF AND MEANS FOR UNRAVELING A PORTION OF TEXTILE YARN

[75] Inventors: Guy Negaty-Hindi, Onex, Switzerland; Carlos Pujol, Barcelona, Spain; Erwin Zurcher, Le Lignon, Switzerland

[73] Assignee: Fomento de Inversiones Industriales S.A., Barcelona, Spain

[21] Appl. No.: 320,098

[22] Filed: Nov. 10, 1981

[30] Foreign Application Priority Data

Nov. 24, 1980 [CH] Switzerland ..... 8646/80

[51] Int. Cl.[3] ..... D01H 15/00

[52] U.S. Cl. ..... 57/22; 57/261

[58] Field of Search ..... 57/22, 23, 261, 262, 57/263

[56] References Cited

U.S. PATENT DOCUMENTS

| | | | |
|---|---|---|---|
| 2,515,172 | 7/1950 | Abbott | 57/1 UN |
| 3,903,680 | 9/1975 | Isern | 57/22 |
| 3,924,394 | 12/1975 | Stahlecker et al. | 57/1 UN |
| 4,229,935 | 10/1980 | Wain | 57/22 |
| 4,263,775 | 4/1981 | Mima | 57/22 |

FOREIGN PATENT DOCUMENTS 2026555 8/1982 United Kingdom .

*Primary Examiner*—Donald Watkins

*Attorney, Agent, or Firm*—Karl F. Ross

[57] ABSTRACT

To unravel a terminal portion of a textile yarn, in particular in preparation for joining that yarn to another one by twisting their ends together, an extremity of the yarn is vibrated to loosen the fibers while a part of the yarn spaced from its end is held fast and the yarn extremity is combed or subjected to an aspirated air stream to remove loose fibers. In a preferred arrangement the air stream also causes vibration of a flexible tongue mounted in an air duct alongside the yarn extremity to oscillate its fibers.

22 Claims, 7 Drawing Figures

METHOD OF AND MEANS FOR UNRAVELING A PORTION OF TEXTILE YARN

FIELD OF THE INVENTION

Our present invention relates to a method of unraveling a portion of a textile yarn, especially a terminal portion to be joined to that of another yarn, and to a device for carrying out this method.

BACKGROUND OF THE INVENTION

In order to splice two textile yarns it is possible to make a knot, which produces a firm but visible joint. A knotless joint can also be made by various methods. Such a joint is less visible than a knot but generally weakens the yarn. The ideal solution involves recreating the conditions of initial twist in the yarn as proposed, for example, in U.S. Pat. No. 2,362,801 or U.S. Pat. No. 3,903,680. The latter patent discloses that, in order to obtain a very strong joint, the fibers at the two ends to be joined should have previously been spread apart so that they can interpenetrate before being subjected to a twist. If the two ends are merely twisted together without prior interpenetration of the fibers, the joint is extremely weak since the two fiber bundles are wound helically around each other, the majority of the fibers therefore not contributing to the strength of the joint.

In order to obtain a bundle of spaced-apart fibers at an extremity of a first yarn capable of interpenetration with another bundle of fibers formed in the same manner at an extremity of a second yarn to be joined thereto, it is sufficient to untwist each of these extremities and to arrange the separated fibers in parallel. However, a separation of the fibers by simple untwisting is possible only with a yarn obtained by ring spinning. On the other hand, it is not possible to proceed in this way with yarns obtained by the so-called open-end spinning method or with ply yarns. In the first case, the fibers do not form more or less parallel and regular helices but are far less well ordered with some extending longitudinally while others are coiled. Consequently, mere untwisting is not sufficient to unravel a portion of such a yarn since the fibers are not all twisted together. In a ply yarn, the plies have to be unraveled first of all and then each yarn has to be unraveled, the ply twist and the twist of the yarns being in opposing directions.

It has consequently been found that the method according to U.S. Pat. No. 3,903,680 is not suitable for all types of yarn and that it can be carried out only if it is possible to unravel the fibers by a method other than untwisting.

OBJECT OF THE INVENTION

Thus, the object of our present invention is to provide a method of and means for unraveling the fibers of a yarn portion, especially of a terminal portion or extremity, so as to permit the joining of interpenetrating fibers of two such extremities, particularly by twisting, whatever the type of yarn.

SUMMARY OF THE INVENTION

To this end, in accordance with our present invention, transverse vibrations are imparted to the fibers of a yarn portion in order to reduce their coefficient of friction so as to loosen them and to spread them apart whereupon they are subjected to a tractive force designed to separate out the fibers hot held in position.

This tractive force, advantageously, is exerted by a longitudinal flow of gas—preferably air—stroking the fibers.

A device for carrying out the method according to our invention thus comprises retaining means for holding a yarn portion at a location spaced from its free end so as to engage the fibers present in the yarn at that location, guide means for juxtaposing this yarn portion with a vibratile member, and excitation means for transversely oscillating this member while exerting a tractive force upon the yarn portion for eliminating therefrom fibers not engaged by the retaining means. The excitation means may comprise an air aspirator or compressor generating the aforementioned longitudinal gaseous flow.

BRIEF DESCRIPTION OF THE DRAWING

The above and other features of the method and of the device according to our invention will become more clearly apparent from the following detailed description, given by way of example with reference to the accompanying drawing in which.

SPECIFIC DESCRIPTION

Figure 1:
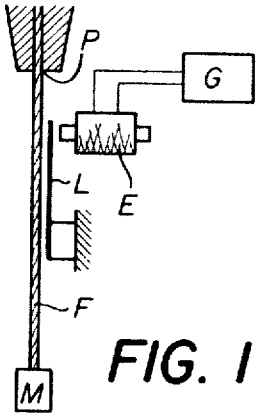
FIG. 1 illustrates schematically the principle underlying the method of our invention.

FIG. 1 shows a portion of yarn F having one end elongated at P while its other, free end engages a weight M of approximately 5 to 10 g. The yarn will untwist under the influence of this weight. If the yarn used has been produced on a ring-spinning frame, the weight M held by the twist will fall after a certain number of turns, taking with it the untwisted fibers which are not held fast at P. On the other hand, if the yarn has been obtained by the open-end spinning method, not all the fibers will undergo untwisting as some of them did not participate directly in the overall twisting of the yarn so that the weight M will be held by these latter fibers and will not fall.

FIG. 1 also shows a vibratile strip L fixed on a support so as to lie close to the yarn and parallel thereto. An electromagnet E supplied with pulses of current by a generator G is arranged so as to excite the strip L into vibrations which oscillate the fibers of the yarn F, thus reducing their coefficient of friction and spreading them apart. As a result, all the fibers not clamped at P will be separated from the others under the traction of the weight M; the weight will fall after a certain period if the frequencies of the strip L and of the pendulum system formed by the yarn F and the weight M are different and are not harmonically related. In the present instance, the frequency of the strip L is 100 Hz and the fibers are separated under the influence of the weight M within a few seconds. A bundle or tuft containing all the fibers held at the clamping point P, whose length corresponds approximately to the average fiber length, is thus obtained at the free end of the yarn F. This is an important factor for obtaining a good joint with another yarn.

The experiment described above demonstrates the effectiveness of the principle underlying the method of our present invention, according to which the vibrations imparted to the fibers of a yarn cause a reduction in their coefficient of friction and the spreading of all the fibers including those which did not participate in the overall twisting of the yarn; this result cannot be achieved by untwisting alone.

Figure 2:
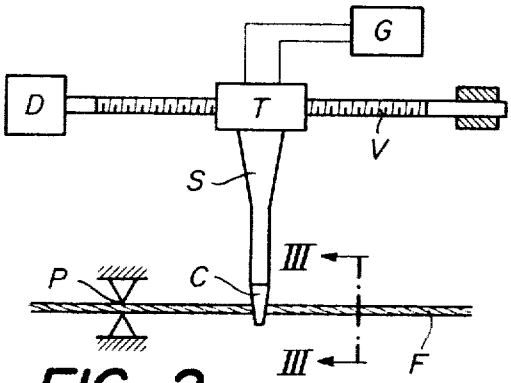
FIG. 2 shows schematically a device for implementing this method.

The device shown in FIG. 2 comprises a comb C carried by an acoustic coupler or sonotrode S which is connected via a transducer T to a pulse generator G. The transducer T is engaged by a leadscrew V driven by a motor D.

Figure 3:
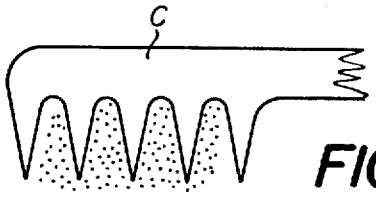
FIG. 3 is a section, on a larger scale, taken along the line III—III of FIG. 2.

In order to unravel the portion of a yarn F which again has one end held at a clamping or gripping point P, the teeth of the comb are inserted into the yarn F (FIG. 3) and are caused to vibrate by means of the sonotrode S. As shown in FIG. 3, the teeth of the comb C penetrate the fibers of the yarn F with a certain freedom so that, when the comb C oscillates, its teeth strike the fibers and therefore impart transverse vibrations to them. The assembly formed by the comb C, the sonotrode S and the transducer T is simultaneously driven by the leadscrew V away from the gripping point P. The movement of the comb C along the yarn causes the untwisting of the fibers and the detachment of the fibers not held at the gripping point P. Moreover, the vibrations reducing the coefficient of friction of the fibers cause them to open up and facilitate the progress of the comb teeth. Once the comb reaches a distance from the gripping point P corresponding to the length of the fibers, the yarn is unraveled and the fibers not clamped at P are separated out.

A fairly satisfactory result can be achieved with the device described above, provided that the movement of the comb C is relatively slow. However, in spite of this precaution, the comb often becomes blocked. Furthermore, the excitation means for causing the comb to advance and vibrate are fairly complex and bulky, which obviously militates against the use of this device in a splicing apparatus.

An advantageous feature of our invention resides in the provision of a vibratile member driven pneumatically with compressed air, which is widely available in the textile industry, and at the natural frequency of that member which can be dimensioned accordingly. By this means, the energy transmitted to the yarn can be greater than the energy developed in the devices described above.

Two embodiments of our invention operating in this manner will now be described, each within the framework of a splicing apparatus otherwise known per se.

Figure 4:
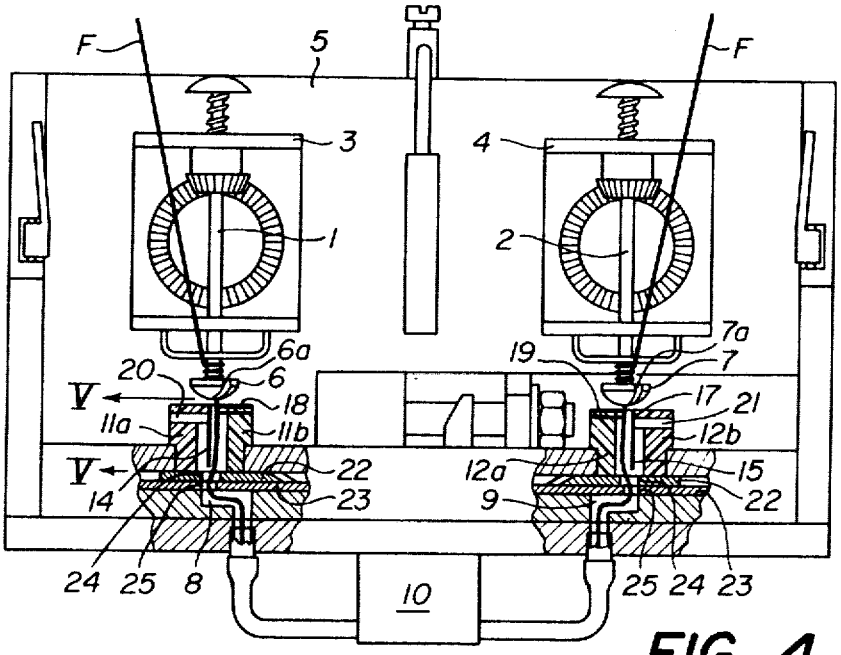
FIG. 4 is an elevational view of a splicing apparatus, shown partially in section, provided with two other devices according to our invention.

The apparatus illustrated in FIG. 4 essentially corresponds to one shown and described in British Pat. No. 2,026,555 to which reference can be made for further details; the present description will be limited to the elements necessary for understanding our invention.

Figure 5:
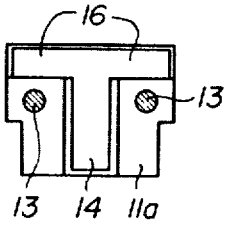
FIG. 5 is a sectional view, on a larger scale, taken along the line V—V in FIG. 4.

This apparatus essentially comprises two spindles 1 and 2 each mounted rotatably in a respective support 3 or 4 which in turn is able to oscillate in a frame 5 on an axis orthogonal to that of the spindle. Spindles 1 and 2 respectively terminate at one end in circular heads 6 and 7 which have radial slots 6*a* and 7*a* engaging yarns F to wind them around the associated spindle bodies. The supports 3 and 4 are capable of occupying one position (not shown) in which the spindles 1 and 2 are coaxial and another position in which they are parallel to each other. In this latter position, which is the one shown in FIG. 4, each spindle 1 and 2 lies upstream of an intake end of a respective suction duct 8 or 9 connected to an air aspirator 10. The intake end of each of these ducts is formed by two parts 11*a*, 11*b* and 12*a*, 12*b*, respectively, which extend approximately longitudinally of the duct. These two parts are secured to each other by means of screws 13 (FIG. 5). Along these end parts of each duct 8 and 9 there extends a flexible oscillatory element constituted by a respective tongue 14 or 15 which is integral with a mounting tab 16 or 17 gripped between the corresponding end parts 11*a*, 11*b* or 12*a*, 12*b* while forming a T with the corresponding tongue. These oscillatory elements are preferably cut from a rubber membrane which is approximately 0.25 mm thick. Each of the tongues 14 and 15 is preferably located in the vicinity of the longitudinal axis of the associated duct so as to be able to float freely therein. The cross-section of these ducts 8 and 9, at least in the part in which the tongue 14 or 15 respectively extends, is preferably square or rectangular so that the free end of the tongue can strike two opposite walls of the duct. Combs 18 and 19 are fixedly mounted in the vicinity of the yarn-intake openings of the ducts 8 and 9, respectively. Channels 20 and 21 designed for the intake of secondary air respectively open into the ducts 8 and 9. A pair of shears, each formed by two relatively slidable steel blades 22 and 23 with openings 24, 25, respectively extend across the suction ducts 8 and 9.

In order to prepare the two ends of yarn to be joined, each of them is introduced nto one of the ducts 8 and 9 in which there prevails a slight partial vacuum created by the aspirator 10. Once a certain length of yarn has been introduced into each duct, the spindles 1 and 2 are caused to turn in opposite directions so that a portion of the respective yarn is wound on each one of them since it is held in the slot 6*a* and 7*a* of the respective spindle head 6 or 7. The blades 22 are then caused to slide relatively to the blades 23 of the two pairs of shears to cut the yarns in the ducts at the level of the openings 25 and 25 so that the upper part of each duct 8 and 9 contains a portion of yarn engaged at one end by the respective spindle.

After this preliminary operation, which is identical with the one described in British Pat. No. 2,026,555, the flow of air aspirated through the ducts 8 and 9 is increased so as to oscillate the tongues 14 and 15 and to exert a pulling force on the yarn portion in the duct. The transverse oscillations of these tongues against the yarns spread the adjoining fibers. As the yarns are simultaneously stroked by the passing air stream, the loosened fibers which are no longer attached to the strands of yarn wound around the spindles 1 and 2 become separated so that a bundle of detached fibers appears at the end of each unraveled yarn portion and can be removed. The remaining aplicing operations, with interleaving of the spaced-apart fibers of the two yarn extremities, are carried out as described in the abovementioned British patent. Since the actual splicing does not form part of our present invention, these operations will not be described here and reference can be made to that British patent for further details on this subject.

It should be noted that the elbow formed in each duct 8 and 9 beneath the shears 22, 23 permits a certain untwisting of the yarn to be induced in the conduit portion upstream of each elbow during the winding of the yarn on spindles 1 and 2. The direction of twist of the fibers in this conduit portion should be opposite to the direction of rotation of the spindle. If, in an open-end yarn, a considerable porportion of the fibers are not twisted, the transverse vibrations imparted to these fibers by the aerodynamically excited tongues 14 and 15 reduce their coefficient of friction so that all the fibers not engaged by the spindles 1 and 2 are eliminated by the longitudinal air stream circulating in the ducts; only the spread-out fibers held by the spindles remain in the ducts and form the two tufted yarn extremities to be joined by twisting.

It will be seen from the description of FIGS. 4 and 5 that each of the two assemblies connected to the splicing apparatus, comprising duct 8 or 9 open at both ends, flexible oscillatory element 14 or 15 and an inlet or air aspirator 10, constitutes a device for carrying out the method according to our present invention.

We have found that this device permits the unraveling of yarns which could not be unraveled hitherto by the mere effect of the conventional components of such a splicing apparatus, i.e. fixed combs 18 and 19 as well as means for generating the air stream in the ducts 8 and 9. The yarn is unraveled within one second. It is obvious that this device is far more effective than the two devices shown in FIGS. 1 and 2. It is much more reliable, is much simpler to produce and permits the duration of the operation to be reduced.

Figure 6:
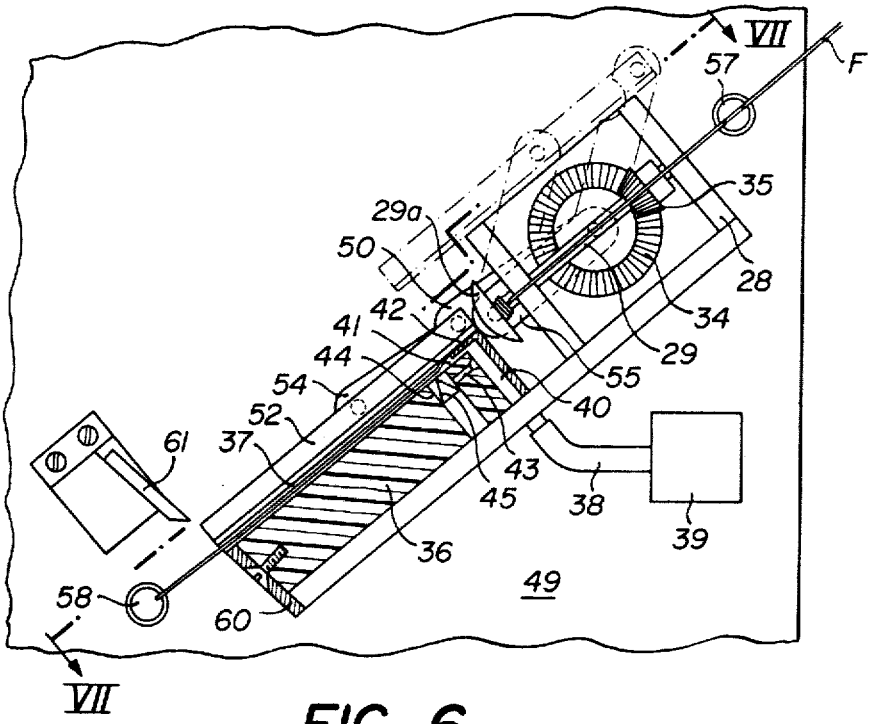
FIG. 6 is an elevational view of another splicing apparatus provided with a further device according to our invention.
Figure 7:
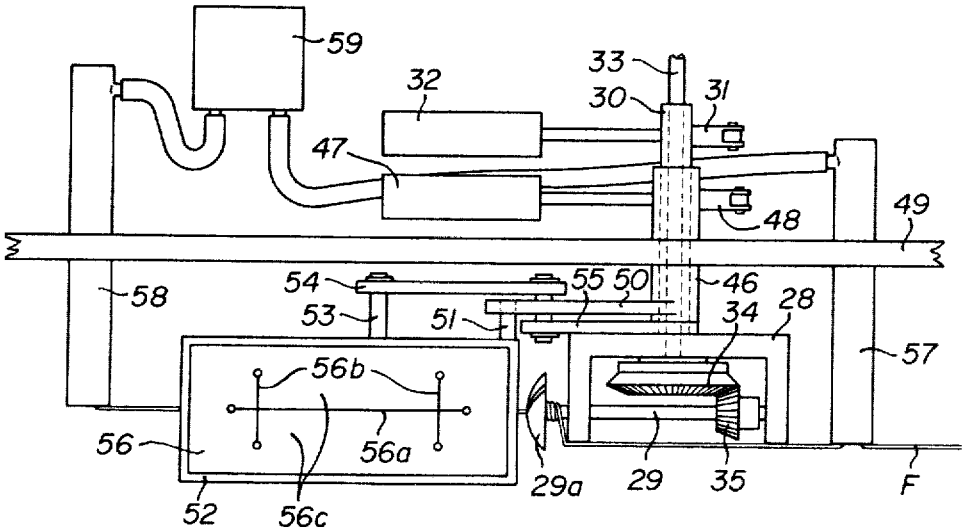
FIG. 7 is a view taken substantially along the line VII—VII in FIG. 6.

FIGS. 6 and 7 illustrate another embodiment of our invention, comprising a pneumatic device connected to a splicing apparatus of the type disclosed in our copending application Ser. No. 199,832 filed Oct. 23, 1980, now U.S. Pat. No. 4,356,688, to which reference can be made for further details of the actual splicing operations.

FIGS. 6 and 7 show only one of two oscillating supports 28, which bears a spindle 29 mounted rotatably about an axis orthogonal to the axis of oscillation of the support 28 and provided with a radially slotted head 29*a*. The other support, not shown, is, identical with support 28 and its illustration is not necessary for understanding the invention since the operation involving unraveling the ends of yarn to be joined is carried out in a symmetrical manner on the two supports.

The yoke-shaped support 28 is integral with a tubular shaft 30 to which there is fixed a radial arm 31 connected to the piston rod of a jack 32. A shaft 33, one end of which bears a bevel pinion 34, traverses the tubular shaft 30. This pinion 34 meshes with a second bevel pinion 35 keyed to the shaft of spindle 29. A plate 36 having a channel 37 and a distribution chamber 40, onto which opens an inlet duct 38 connected to a compressed-air source 39, is fixed to the support 28. The distribution chamber 40 has a nozzle 41 at the level of the channel 37 defined by a lip 42 forming an outlet along the surface of this channel. A bypass 43 connects the chamber 40 to a bore 44 in which there is fixed a cone 45 whose tip is adjacent the bottom of the channel 37 and whose axis of revolution is perpendicular to the bypass 43. Secondary air from this bypass, directed toward the cone 45, meets the main air stream leaving the nozzle 41 and locally widens this stream to enlarge the tuft of fibers as described in our prior application and patent identified above. However, this feature is not material to our present invention.

A second tubular shaft 46, connected to the rod of a jack 47 by a radial arm 48, is mounted pivotally on the tubular shaft 30 and traverses a framework 49. This tubular shaft 46 is integral with a further radial arm 50 an end of which is pivoted on a mounting rod 51 connected to a frame 52. A second mounting rod 53 secured to the same frame 52 pivotally supports an arm 54 that is parallel to the radial arm 50 and articulated to an end of another radial arm 55 integral with the tubular shaft 30 so as to form therewith a parallelogrammatic linkage including the frame 52.

The frame 52 bears a natural-rubber membrane 56, having a thickness of approximately 0.25 mm, which has a longitudinal slot 56*a* and two transverse slots 56*b* defining two tongues 56*c* whose longitudinal edges adjoin each other. This frame 52 is capable of occupying two positions relative to the support 28 controlled by the jack 47. In one of these positions, shown in full lines, the frame 52 overlies the plate 36 and its channel 37 while in the other, shown in dot-dash lines in FIG. 6, it is remote therefrom.

Two suction tubes 57 and 58 connected to a low-pressure source or air aspirator 59 are arranged on either side of the oscillating support 28 and of its plate 36 when the support is located in the full-line position shown in FIG. 6. These tubes serve to stretch a yarn F across the plate 36 while the frame 52 is lifted off this plate and to hold the yarn against the rim of the slotted head 29*a* of the spindle 29. This spindle is rotated by the shaft 33 and pinions 34 and 35. The yarn F penetrates the slot in the head 29*a* and is wound around the spindle 29. The direction of rotation of the spindle is selected so as to untwist the portion of yarn lying between the head 29*a* and the suction tube 58, as explained in detail in our above-identified prior application and patent.

Once the yarn has been wound around the spindle 29, the frame 52 bearing the membrane 56 is brought against the plate 36 with the aid of its parallelogrammatic linkage 50, 54 and 55 so that the membrane 56 forms an upper wall of channel 37 and covers the yarn situated therein. Some compressed air is then fed into the distribution chamber 40 and thence into the channel 37. The air stream traversing this channel and stroking the yarn F engaged by spindle 29 causes the tongues 56*c* to vibrate and to strike the yarn which is simultaneously subjected to a pulling force due to the friction of the air stream. The yarn is unraveled completely and the fibers not held by the spindle 29 are separated and extracted by the air stream.

Thus, a device according to our invention, incorporated into the splicing apparatus of FIGS. 6 and 7, is formed by the channel 37, the membrane 56 with its tongues 56*c*, and the compressed-air source 39 with conduits 38, 40 generating the gas flow in channel 37.

Tests have shown that this device allows a yarn of any type to be unraveled rapidly and completely. It should be noted that in certain instances, particularly with ply yarns, it is necessary to cut the yarn before unraveling it by the method according to our present invention. To this end a moving knife 60 is fixed to the plate 36 and a stationary knife 61 is fixed to the framework 49. A slight rocking of the plate 36 by the jack 32 allows the yarn to be cut before undergoing the unraveling operation described above.

Generally speaking, the vibratile elements such as tongues 56*c*, excited aerodynamically by the passing longitudinal air stream, have been dimensioned so as to vibrate at frequencies of the order of 500 to 2000 Hz.

We have found that the results are best within this range of frequencies with elements made of an elastomeric material as flexible as rubber, having a thickness of the order of from 0.2 to 0.3 mm, capable of vibrating at these frequencies with amplitudes of the order of a millimeter.

Interesting applications of the method and of the device according to our present invention include, inter alia, all cases involving the joining of yarns and the preparation of yarns for splicing, in particular those which are difficult to unravel such as open-end yarns and ply yarns. The method can thus be applied to the preparation of open-end yarns which are to be joined outside or inside a spinning turbine during a spinning operation.

We claim:

1. A method of unraveling a portion of a yarn of textile fibers, comprising the steps of:

(a) gripping a yarn portion to be unraveled at a location spaced from a free end thereof to engage fibers present at said location;

(b) closely juxtaposing a vibratile member with said yarn portion;

(c) exciting said vibratile member to impart transverse oscillations to said yarn portion for loosening the fibers thereof and spreading them apart; and (d) stroking the fibers of said yarn portion with a longitudinal flow of gas passing therealong toward said free end with resulting removal from said yarn portion of fibers not engaged at said location.

2. A method as defined in claim 1 wherein the yarn is subjected to an untwisting rotation at said location.

3. A method as defined in claim 1 wherein the excitation of the vibratile member in step (c) is accomplished aerodynamically by exposure thereof to said longitudinal flow of gas.

4. A method as defined in claim 3 wherein said gas is air.

5. A method as defined in claim 1 wherein the fibers are oscillated by said vibratile member with a frequency in a range between substantially 500 and 2000 Hz.

6. A method of splicing terminal portions of two yarns of textile fibers, comprising the steps of:

(a) gripping each yarn at a location spaced from a free end of the respective terminal portion, thereby engaging fibers thereof present at said location;

(b) closely juxtaposing respective vibratile members with said terminal portions;

(c) exciting said vibratile members to impart transverse oscillations to the respective terminal portions for loosening the fibers thereof and spreading them apart;

(d) stroking the fibers of each terminal portion with a respective longitudinal flow of gas passing therealong toward said free end with resulting unraveling of each terminal portion and removal therefrom of fibers not engaged at said location; and (e) interleaving the spread-apart fibers of said terminal portions.

7. A method as defined in claim 6 wherein each yarn is subjected to an untwisting rotation at said location.

8. A method as defined in claim 6 wherein the excitation of the vibratile members in step (c) is accomplished aerodynamically by exposure thereof to the respective longitudinal flow of gas.

9. A method as defined in claim 6 wherein said gas is air.

10. A method of unraveling a portion of a yarn of textile fibers, comprising the steps of:

(a) gripping the yarn at a location spaced from a free end of the yarn portion to be unraveled, thereby engaging fibers thereof present at said location;

(b) setting said yarn portion in oscillations at a frequency in a range between substantially 500 and 2000 Hz for spreading the fibers thereof apart; and (c) exerting upon said yarn portion a tractive force directed toward said free end for removing therefrom fibers not engaged at said location.

11. A method as defined in claim 10 wherein said tractive force is generated by passing a gaseous flow along said yarn portion.

12. A method as defined in claim 11 wherein said gaseous flow is an air stream.

13. A method as defined in claim 10 wherein the oscillations of step (b) are generated by juxtaposing said portion with a vibrating member.

14. A device for unraveling a portion of a yarn of textile fibers, comprising:

a vibratile member;

guide means for closely juxtaposing a yarn portion to be unraveled with said vibratile member;

retaining means engageable with said yarn portion at a location spaced from a free end thereof for holding fibers present at said location in position; and excitation means for transversely oscillating said member with resulting vibration and spreading of the fibers of said yarn portion and with concurrent exertion upon said yarn portion of a tractive force directed toward said free end for removing therefrom fibers not held by said retaining means.

15. A device as defined in claim 14 wherein said vibratile member is a comb with teeth penetrating said yarn portion, said excitation means comprising an oscillator coupled with said comb and provided with drive means for jointly displacing said oscillator and said comb along said yarn portion toward said free end.

16. A device as defined in claim 15 wherein said oscillator comprises a sonotrode.

17. A device as defined in claim 14 wherein said guide means forms a duct accommodating said yarn portion alongside said vibratile member, said excitation means comprising a source of gas traversing said duct for stroking the fibers of said yarn portion.

18. A device as defined in claim 17 wherein said retaining means comprises a spindle adjacent an entrance end of said duct adapted to have part of said yarn portion wound thereon, said spindle being rotatable in a fiber-untwisting direction.

19. A device as defined in claim 17 wherein said vibratile member comprises a strip of elastomeric material positioned to extend alongside said yarn portion.

20. A device as defined in claim 19 wherein said strip is part of a membrane forming a longitudinal wall of said duct.

21. A device as defined in claim 20 wherein said strip is one of two tongues with adjoining longitudinal edges integral with and partly cut from said membrane.

22. A device as defined in claim 20 or 21 wherein said membrane is detachable from a fixed part of said guide means forming other walls of said duct.

* * * * *